US012349809B2

(12) United States Patent
Chen et al.

(10) Patent No.: US 12,349,809 B2
(45) Date of Patent: Jul. 8, 2025

(54) FOLDABLE CHAIR

(71) Applicant: Te-Lung Chen, Tainan (TW)

(72) Inventors: Te-Lung Chen, Tainan (TW); Pin-Yi Chen, Tainan (TW); Pin-Han Chen, Tainan (TW)

(73) Assignee: Te-Lung Chen, Tainan (TW)

( * ) Notice: Subject to any disclaimer, the term of this patent is extended or adjusted under 35 U.S.C. 154(b) by 219 days.

(21) Appl. No.: 18/314,548

(22) Filed: May 9, 2023

(65) Prior Publication Data

US 2024/0374033 A1 Nov. 14, 2024

(51) Int. Cl.
*A47C 4/28* (2006.01)
*A47C 4/30* (2006.01)
*A47C 7/46* (2006.01)

(52) U.S. Cl.
CPC ..... *A47C 4/286* (2013.01); *A47C 4/30* (2013.01); *A47C 7/462* (2013.01)

(58) Field of Classification Search
CPC ..... A47C 4/286; A47C 7/462
USPC ..... 297/24, 25, 26, 27, 28, 284.7
See application file for complete search history.

(56) References Cited

U.S. PATENT DOCUMENTS 4,072,341 A * 2/1978 Kurz ..... A47C 1/035 297/27 X
4,715,650 A * 12/1987 Berman ..... A47C 4/42 297/28 X
4,730,871 A * 3/1988 Sheldon ..... A47C 7/462 297/284.7
4,776,634 A * 10/1988 Pugliese ..... A47C 1/026 297/28 X
4,784,432 A * 11/1988 Brown ..... A47C 1/0265 297/28 X
5,975,632 A * 11/1999 Ginat ..... A47C 7/462 297/284.7
6,059,362 A * 5/2000 Lin ..... A47C 7/462 297/284.7
6,419,318 B1 * 7/2002 Albright ..... A47C 7/462 297/284.7
6,840,574 B1 * 1/2005 Wu ..... A47C 1/0265 297/45 X
7,104,604 B1 * 9/2006 Kang ..... A47C 7/46 297/284.7
7,641,276 B1 * 1/2010 Chen ..... A47C 4/286 297/42
8,449,037 B2 * 5/2013 Behar ..... A47C 7/46 297/297

(Continued)

*Primary Examiner* — Rodney B White
(74) *Attorney, Agent, or Firm* — MUNCY, GEISSLER, OLDS & LOWE, P.C.

(57) ABSTRACT

A foldable chair includes a chair frame mechanism that is operable between an unfolded state and a folded state and that includes a seat unit, a backrest unit, and a support unit. The backrest unit extends from and cooperates with the seat unit to define a seating space when the chair frame mechanism is in the unfolded state. The support unit is mounted to the backrest unit, and includes a spine rod disposed rearwardly of the backrest unit and being upwardly and downwardly movable for driving operation of the chair frame mechanism between the folded state and the unfolded state. A movable seat is sleeved on and slidable along the spine rod. A cushion pad is connected to the movable seat and is disposed between the movable seat and the backrest unit.

8 Claims, 12 Drawing Sheets

(56) References Cited

U.S. PATENT DOCUMENTS

| | | | | |
|---|---|---|---|---|
| 8,926,016 | B2 * | 1/2015 | Behar | A47C 5/12 297/284.7 X |
| 9,173,495 | B2 * | 11/2015 | Goldszer | A47C 4/18 |
| 9,451,829 | B2 * | 9/2016 | Chen | A47C 4/286 |
| 10,477,973 | B2 * | 11/2019 | Gerbino | A47C 7/462 |
| 11,659,930 | B1 * | 5/2023 | Chen | A47C 4/286 297/16.1 |
| 11,684,161 | B1 * | 6/2023 | Chen | A47C 4/286 297/250.1 |
| 12,096,860 | B2 * | 9/2024 | Yang | A47C 4/286 |
| 2002/0043841 | A1 * | 4/2002 | Giacinto | A47C 7/38 297/284.7 |
| 2002/0135210 | A1 * | 9/2002 | Tseng | A47C 1/0265 297/28 |
| 2005/0062323 | A1 * | 3/2005 | Dicks | A47C 7/402 297/284.4 |
| 2010/0072790 | A1 * | 3/2010 | Pleiman | A47D 1/0085 297/16.2 |
| 2012/0175917 | A1 * | 7/2012 | Chen | A47C 4/286 297/29 |
| 2024/0277154 | A1 * | 8/2024 | Diggins | A47C 7/443 |

* cited by examiner

FOLDABLE CHAIR

FIELD

The disclosure relates to a foldable chair, and more particularly to a foldable chair with a cushion mechanism.

BACKGROUND

FIGS. 1 to 3 illustrate a conventional foldable chair that is operable between an unfolded state and a folded state, and that includes a seat unit 91, a backrest unit 92, a support unit 93, and an armrest unit 99. The seat unit 91 includes two seat rods 911 spaced apart from each other, two front leg rods 912 respectively and pivotally connected to the seat rods 911, two rear leg rods 913 respectively and pivotally connected to the seat rods 911, and a seat cover 914 connected between the seat rods 911 in a foldable manner. The backrest unit 92 includes two spaced-apart backrest rods 921 that are disposed above the seat unit 91 and that are respectively pivotally connected to rear ends of the seat rods 911. A backrest cover 922 is connected between the backrest rods 921 in a foldable manner.

The support unit 93 is disposed rearwardly of the backrest unit 92, and includes a spine rod 94, a first link rod unit 95, a second link rod unit 96, and two rod connectors 97. The first link rod unit 95 includes a first hinge seat 951 that is mounted to a top end of the spine rod 94, and two first rods 952 each of which is pivotally connected between the first hinge seat 951 and an upper portion of a respective one of the backrest rods 921. The second link rod unit 96 includes a second hinge seat 961 that is mounted to a bottom end of the spine rod 94, and two second rods 962 that are respectively and pivotally connected to left and right ends of the second hinge seat 961. An end of each of the second rods 962 is fixed to a respective one of the rod connectors 97 in a non-rotatable manner. Each of the rod connectors 97 is connected to the lower portion of a respective one of the backrest rods 921 so as to limit the respective one of the backrest rods 921. The armrest unit 99 includes two armrest bodies 991 each of which is pivotally connected to a respective one of the backrest rods 921, a respective one of the front leg rods 912, and a respective one of the rear leg rods 913.

When the conventional foldable chair is in the unfolded state, the seat cover 914 is unfolded between the seat rods 911, and the backrest cover 922 is unfolded between the backrest rods 921. As a result, a seating space 90 is formed by the conventional foldable chair. To operate the conventional foldable chair from the unfolded state to the folded state, the first rods 952 are pivotally rotated relative to the first hinge seat 951 so as to move toward each other and the spine rod 94, and the second rods 962 are pivotally rotated relative to the second hinge seat 961 so as to move toward each other and to extend downwardly relative to the spine rod 94. The rod connectors 97 are driven by rotation of the second rods 962 to respectively bring the backrest rods 921 to move toward each other with respect to the spine rod 94. As the seat rods 911 are driven to move upwardly and rearwardly to the backrest unit 92, the front leg rods 912 and the rear leg rods 913 connected to the seat rods 911 are brought together to lean on the armrest bodies 991. The conventional foldable chair is transformed from the unfolded state to the folded state.

However, since the support unit 93 and the backrest cover 922 are spaced apart from each other, when a user sits in the conventional foldable chair, only the user's head or back may be supported by the backrest cover 922.

SUMMARY

Therefore, an object of the disclosure is to provide a foldable chair that can alleviate at least one of the drawbacks of the prior art.

According to the disclosure, a foldable chair includes a chair frame mechanism and a cushion mechanism.

The chair frame mechanism is operable between an unfolded state and a folded state, and includes a seat unit, a backrest unit, and a support unit. The backrest unit extends upwardly from the seat unit, and cooperates with the seat unit to define a seating space when the chair frame mechanism is in the unfolded state. The support unit is mounted to the backrest unit, and includes a spine rod disposed rearwardly of the backrest unit and being upwardly and downwardly movable for driving operation of the chair frame mechanism between the folded state and the unfolded state.

The cushion mechanism is connected to the support unit, and includes a movable seat and a cushion pad. The movable seat is sleeved on and slidable along the spine rod. The cushion pad is connected to the movable seat and is disposed between the movable seat and the backrest unit.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
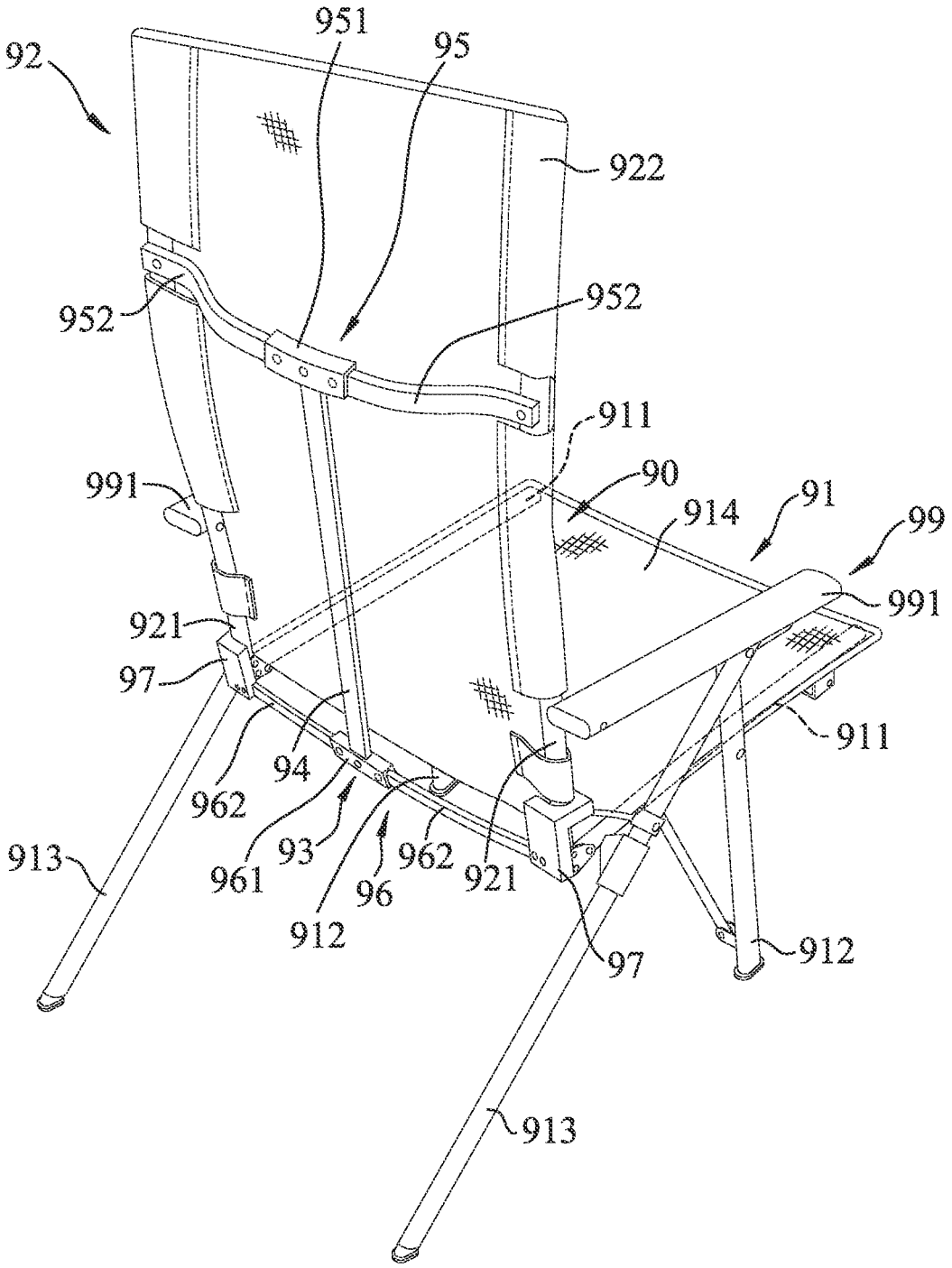
FIG.1 PRIOR ART
FIG. 1 is a perspective view illustrating a conventional foldable chair.
Figure 2:
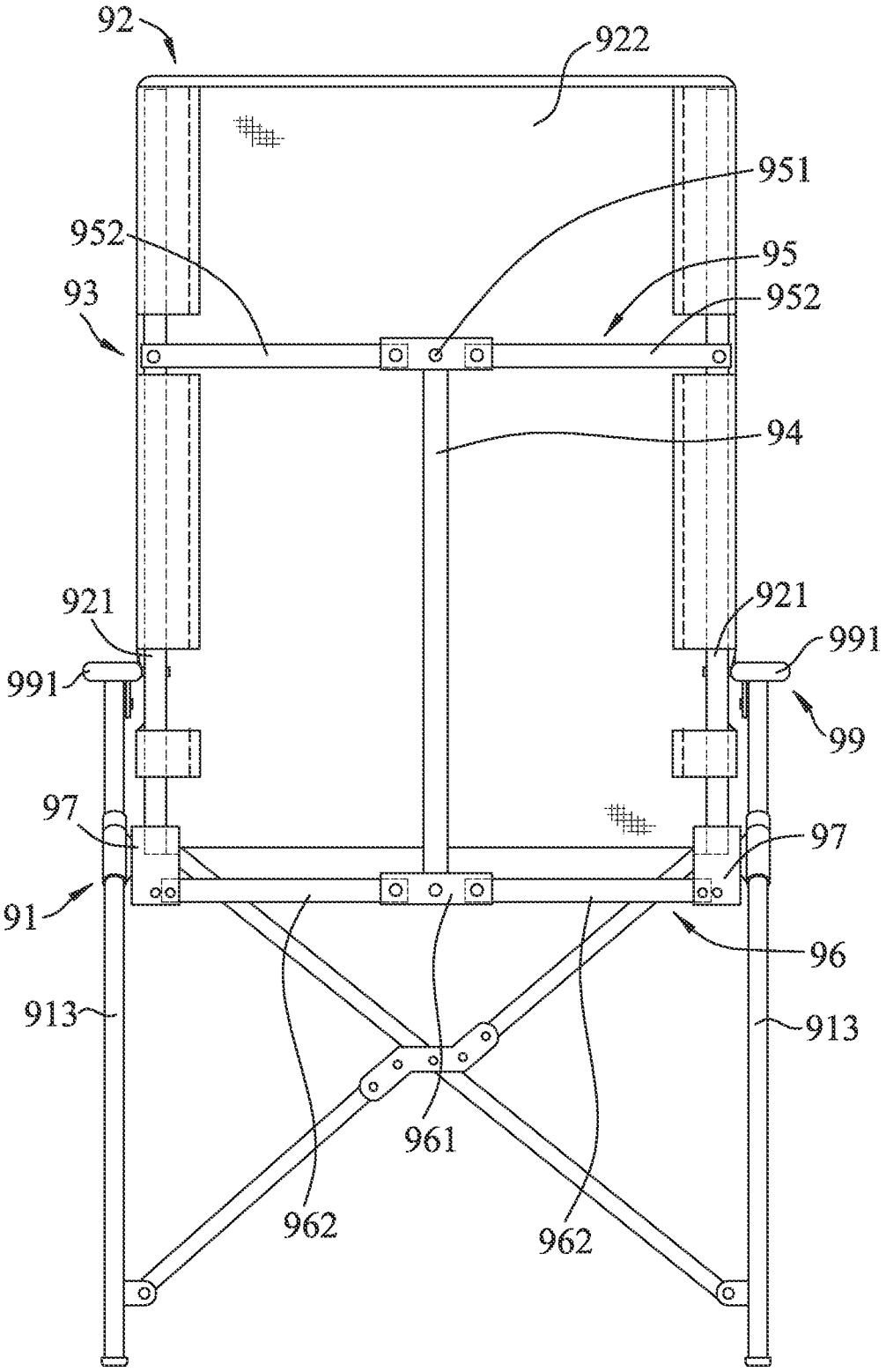
FIG.2 PRIOR ART
FIG. 2 is a rear view of the conventional foldable chair in an unfolded state.
Figure 3:
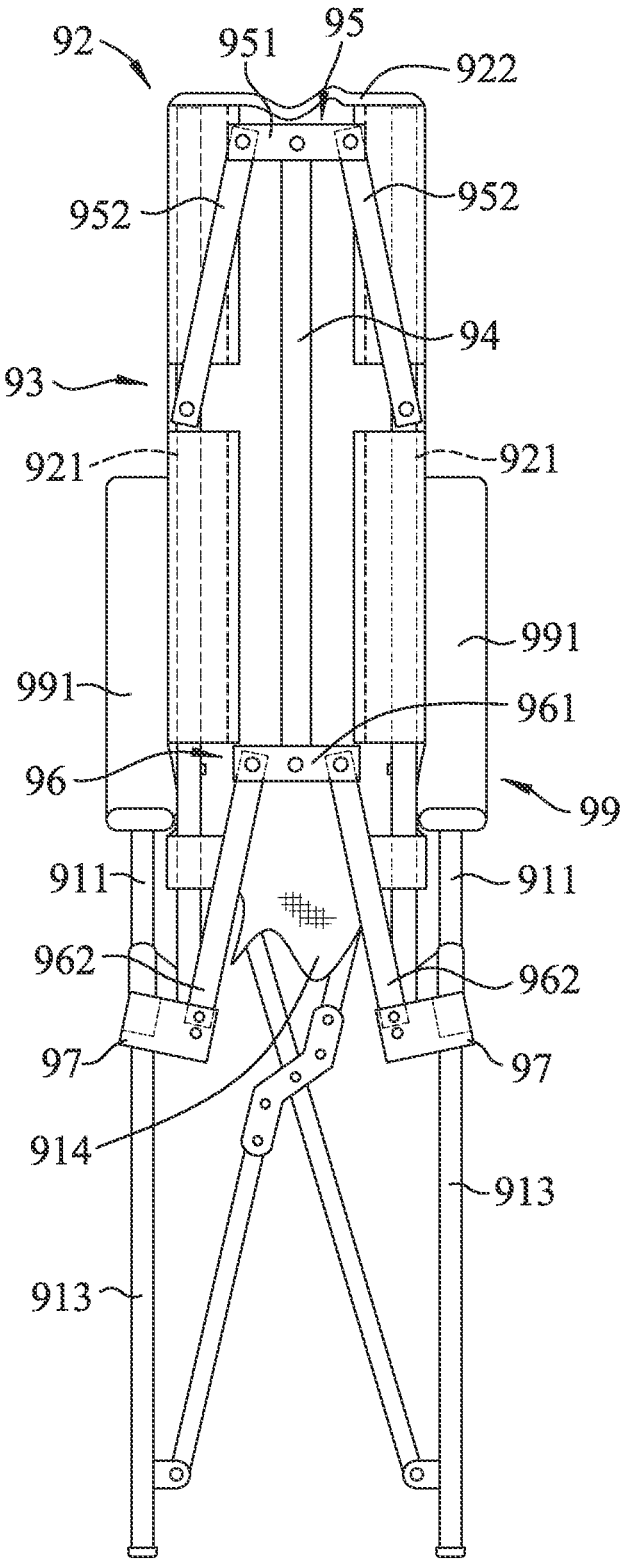
FIG.3 PRIOR ART
FIG. 3 is a rear view of the conventional foldable chair in a folded state.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 4:
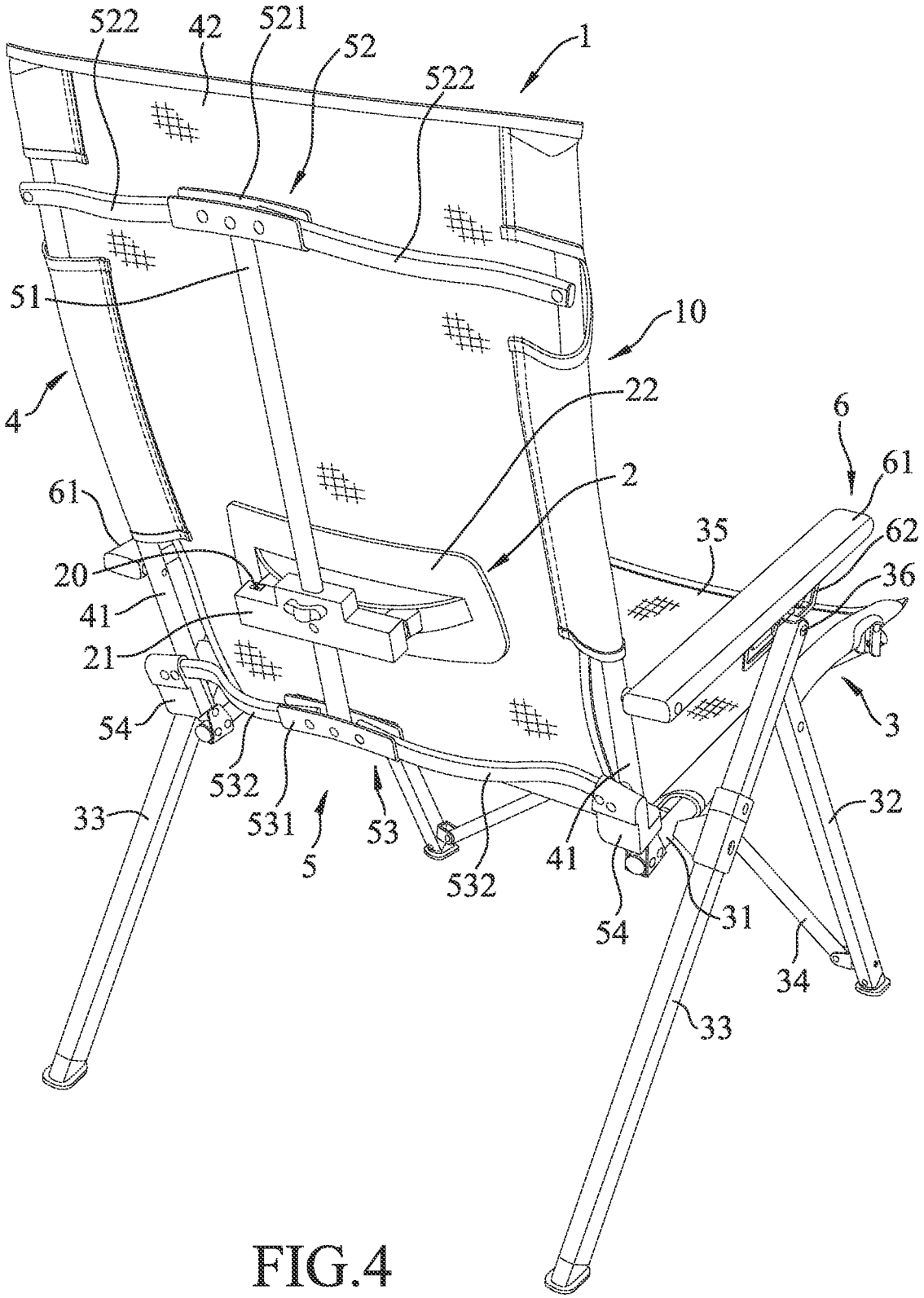
FIG. 4 is a rear perspective view illustrating a foldable chair according to a first embodiment of the disclosure in an unfolded state.
Figure 5:
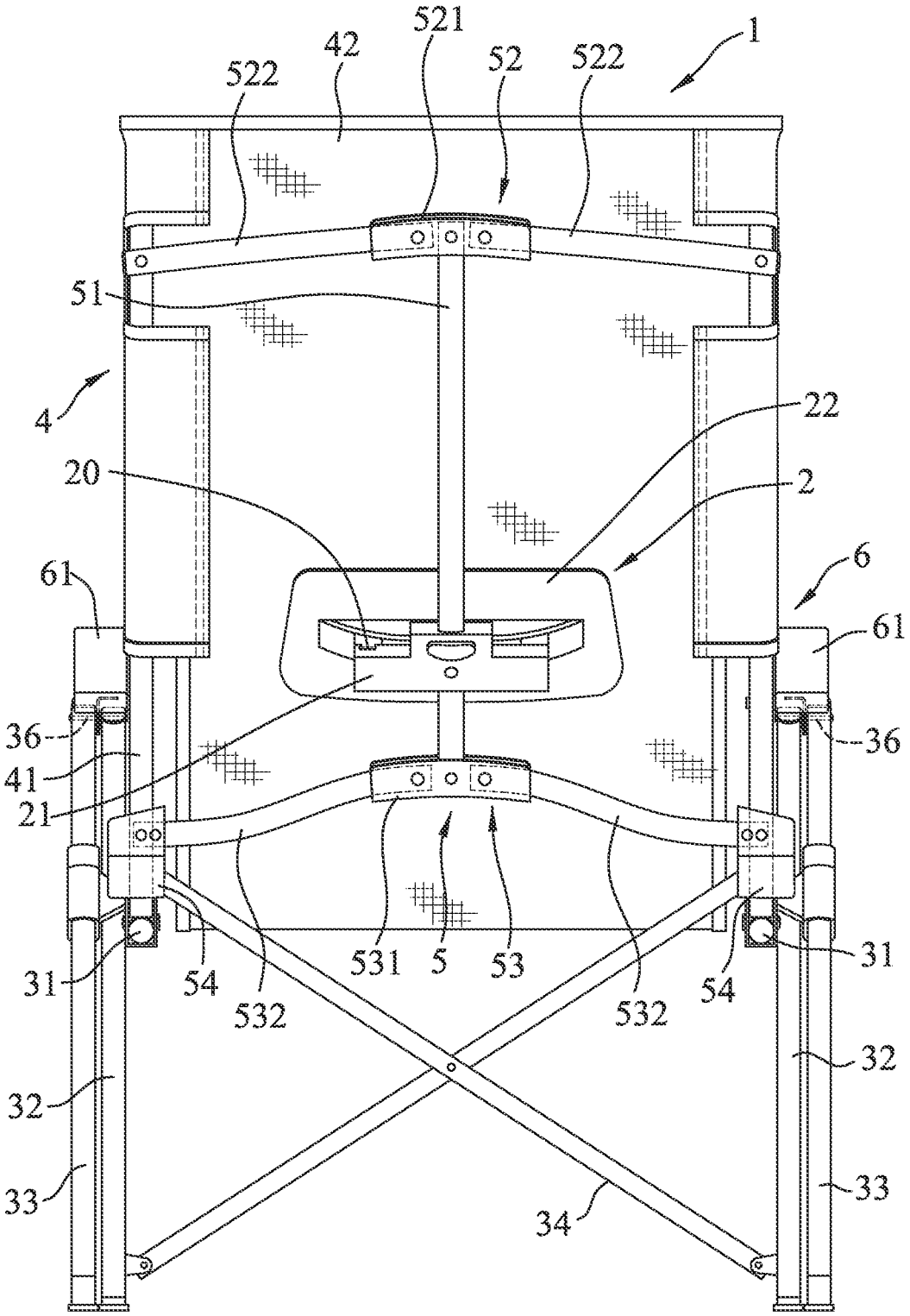
FIG. 5 is a rear view of the first embodiment, illustrating the foldable chair in the unfolded state.
Figure 6:
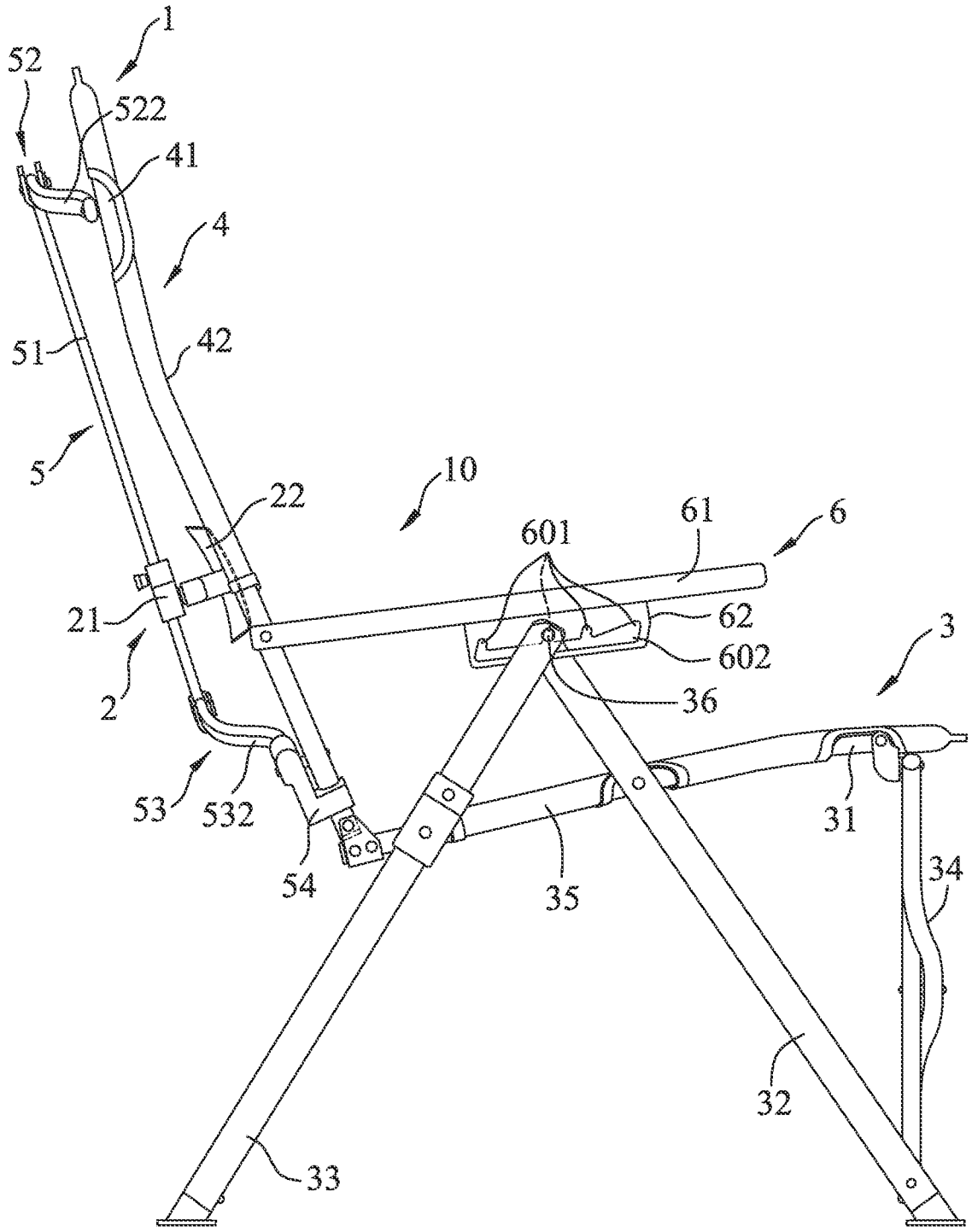
FIG. 6 is a side view of the first embodiment, illustrating the foldable chair in the unfolded state.

Referring to FIGS. 4 to 6, a foldable chair according to a first embodiment of the disclosure includes a chair frame mechanism 1 and a cushion mechanism 2. The chair frame mechanism 1 is operable between an unfolded state and a folded state, and includes a seat unit 3, a backrest unit 4, a support unit 5, and an armrest unit 6.

The seat unit 3 includes two seat rods 31, two front leg rods 32, two rear leg rods 33, a scissor link assembly 34, a seat cover 35, and two positioning pins 36. The two seat rods 31 are spaced apart from each other in a left-right direction and extend in a front-rear direction. The two front leg rods 32 are opposite to each other in the left-right direction, and are respectively and pivotally connected to the seat rods 31. The two rear leg rods 33 are opposite to each other in the left-right direction, and are respectively and pivotally connected to the seat rods 31 at positions rearwardly from where the front leg rods are pivotally connected to the seat rods 31 (see FIG. 6). The scissor link assembly 34 includes two upper ends that are respectively and pivotally connected to top ends of the front leg rods 32, and two lower ends that are respectively and pivotally connected to bottom ends of the front leg rods 32. The seat cover 35 is connected between the seat rods 31. Each of the positioning pins 36 extends in the left-right direction through and pivotally connects the top end of a respective one of the front leg rods 32 and a top end of a respective one of the rear leg rods 33 so that the respective one of the front leg rods 32 and the respective one of the rear leg rods 33 are pivotally rotatable to each other about the respective positioning pin 36.

The backrest unit 4 extends upwardly from the seat unit 3, and includes two backrest rods 41 and a backrest cover 42. The backrest rods 41 are respectively and pivotally connected to rear portions of the seat rods 31. The backrest cover 42 is connected between the backrest rods 41.

Since the structures of the seat unit 3 and the backrest unit 4 are well known in the prior art, details are omitted herewith.

The support unit 5 is mounted to the backrest unit 4, and includes a spine rod 51, a first link rod unit 52, a second link rod unit 53, and two rod connectors 54.

The spine rod 51 is disposed rearwardly of the backrest unit 4, and is upwardly and downwardly movable for driving operation of the chair frame mechanism 1 between the folded state and the unfolded state.

The first link rod unit 52 includes a first hinge seat 521 and two first link rods 522. The first hinge seat 521 is pivotally connected to a top end of the spine rod 51. Each of the first link rods 522 is connected between the first hinge seat 521 and a respective one of the backrest rods 41. The first hinge seat 521 has a U-shaped cross section that is open upwardly. In this embodiment, an end portion of each of the first link rods 522 is pivotally received in and limited by a respective one of a left end portion and a right portion of the first hinge seat 521, and another end portion of each of the first link rods 522 is pivotally connected to an upper part of the respective backrest rod 41.

The second link rod unit 53 includes a second hinge seat 531 and two second link rods 532. The second hinge seat 531 is pivotally connected to an end of the spine rod 51. Each of the second link rods 532 is connected between the second hinge seat 531 and a respective one of the respective backrest rods 41. The second hinge seat 531 has a U-shaped cross section that is open upwardly. In this embodiment, an end portion of each of the second link rods 532 is pivotally received in and limited by a respective one of a left end portion and a right portion of the second hinge seat 531, and another end portion of each of the second link rods 532 is pivotally connected to a lower part of the respective backrest rod 41.

Each of the rod connectors 54 is fixed in a non-rotatable manner to the end portion of a respective one of the second link rods 532 that is pivotally connected to the respective backrest rod 41. The second link rods 532 and the rod connectors 54 are pivotally rotatable together relative to the lower parts of the backrest rods 41 so that the rod connectors 54 may be respectively engaged with or disengaged from the backrest rods 41.

The armrest unit 6 includes two armrest bodies 61 and two engagement plates 62. The armrest bodies 61 are spaced apart from each other in the left-right direction. Each of the armrest bodies 61 is pivotally connected to the lower part of the respective backrest rod 41, and extends in the front-rear direction. The engagement plates 62 are respectively mounted to bottom ends of the armrest bodies 61, and are elongated in the front-rear direction. Each of the engagement plates 62 has a slide passage 602 and four engagement slots 601 that extends therethrough in the left-right direction. The slide passage 602 is elongated in the front-rear direction. The engagement slots 601 are spaced apart from each other in the front-rear direction, and are opening downwardly in communication with the slide passage 602. Each of the engagement plates 62 is situated between the respective front leg rod 32 and the respective rear leg rod 33 so that the respective positioning pin 36 may extend through and slide along the slide passage 602 so as to be adjustably inserted into one of the engagement slots 601.

It should be noted that the number of the engagement slots 601 is not limited to four, and may be one, two, three or greater than five.

Figure 7:
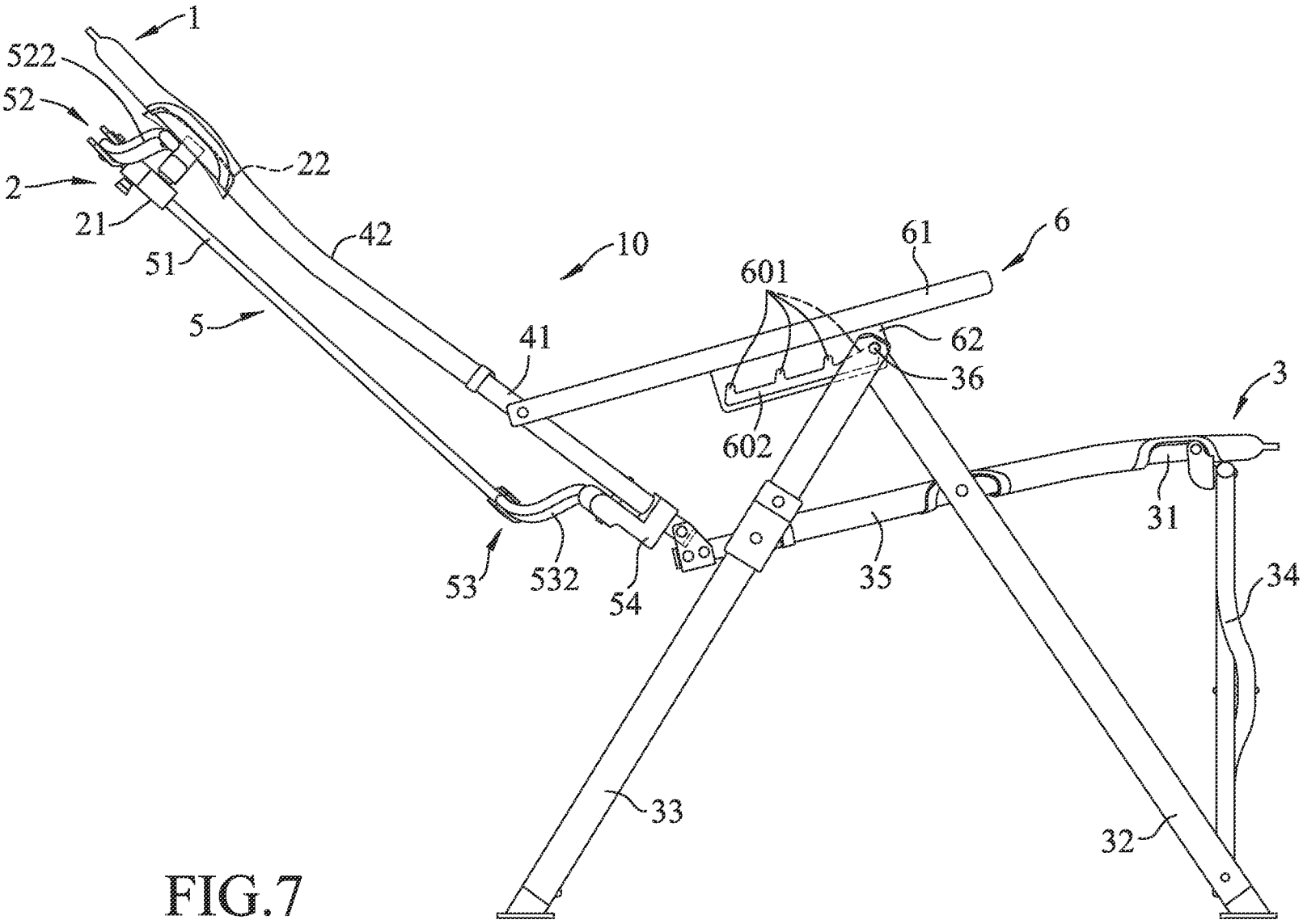
FIG. 7 is a view similar to FIG. 6, but illustrating a backrest unit being adjustable to be inclined by a great angle and backwardly relative to a seat unit of the foldable chair.

Referring to FIGS. 6 and 7, each of the armrest bodies 61 may drive pivotal rotation of the backrest rod 41 relative to the seat unit 3 and bring disengagement of each of the positioning pins 36 from a respective one of the engagement slots 601 of the respective engagement plate 62 such that the respective positioning pin 36 is moved to the slide passage 602. When the positioning pins 36 are respectively moved to the slide passage 602 of the engagement plates 62, the armrest unit 6 may be moved relative to the seat unit 3 so as to drive inclination of the backrest unit 4 relative to the seat unit 3 until each of the positioning pin 36 is engaged with a predetermined one of the engagement slots 601 of the respective engagement plate 62.

By virtue of the armrest unit 6 being connected to the backrest unit 4 and the positioning pins 36, since each of the positioning pins 36 may slide along the slide passage 602 of the respective engagement plate 62 to be adjustably inserted into one of the engagement slots 601 of the respective engagement plate 62, an inclined angle of the backrest unit 4 relative to the seat unit 3 is adjustable.

Figure 8:
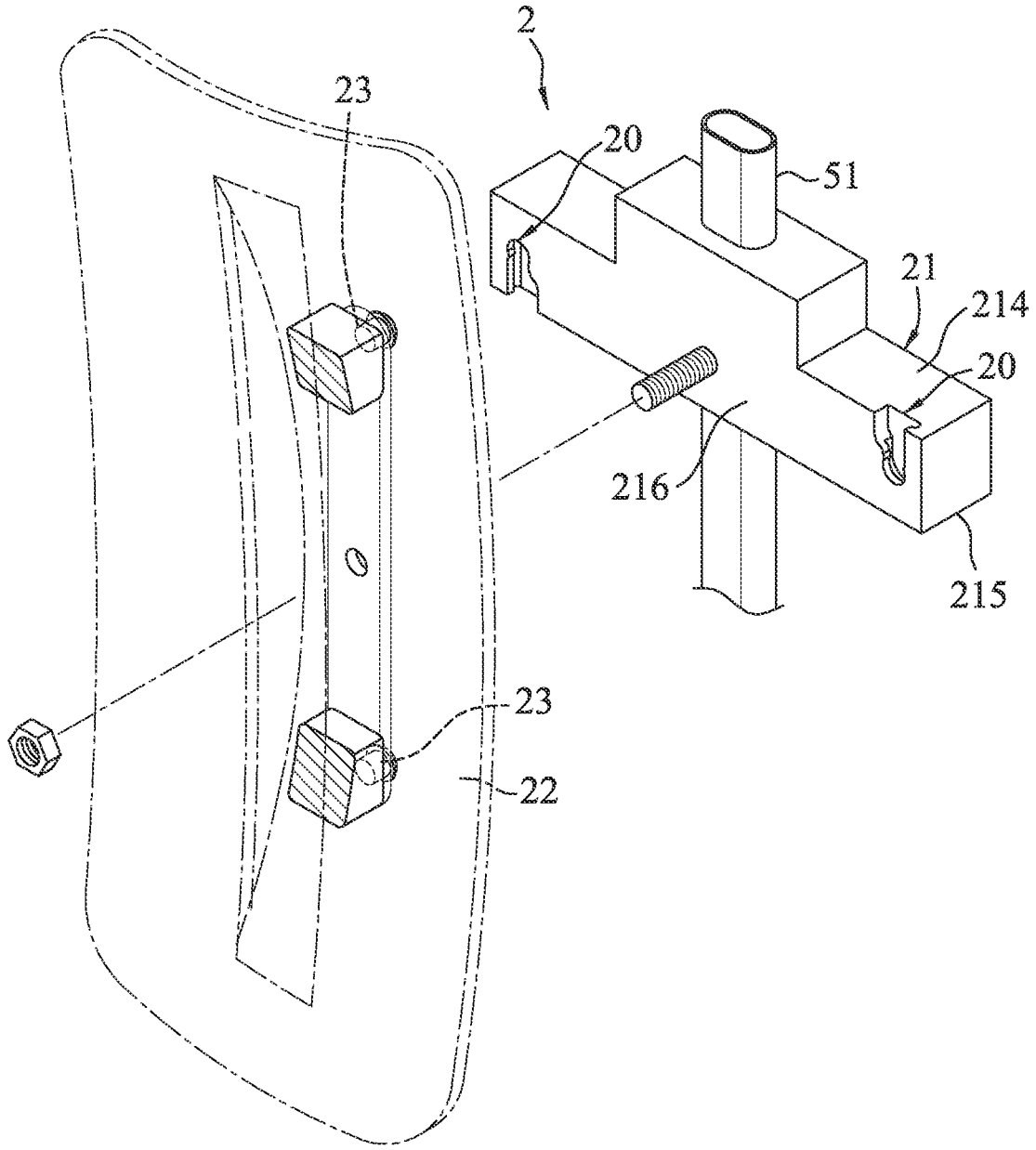
FIG. 8 is a fragmentary, partly sectional, perspective view of the first embodiment, illustrating a movable seat and a cushion pad of a cushion mechanism of the foldable chair.
Figure 9:
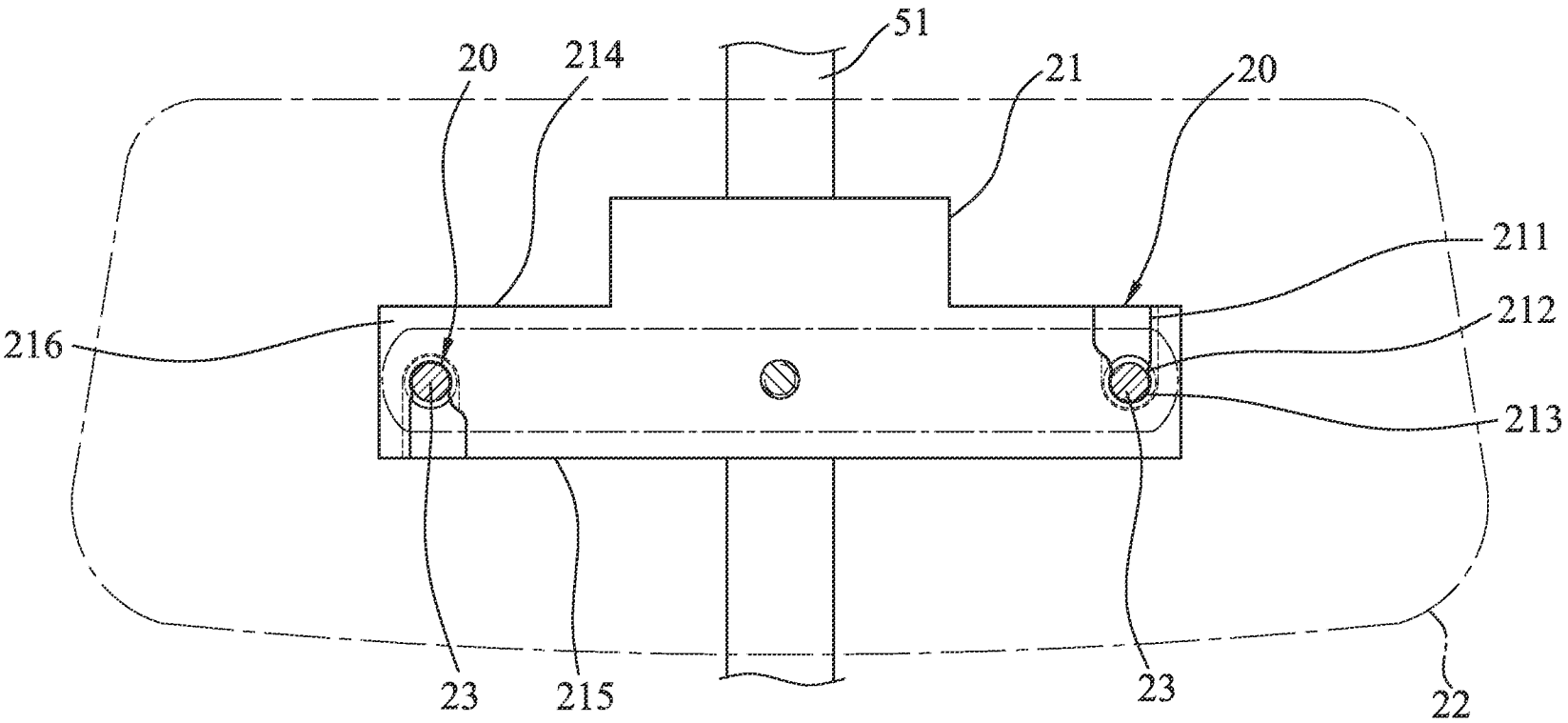
FIG. 9 is a fragmentary, partly sectional, perspective view of the first embodiment, illustrating the cushion pad rotated relative to the movable seat in a first state.
Figure 10:
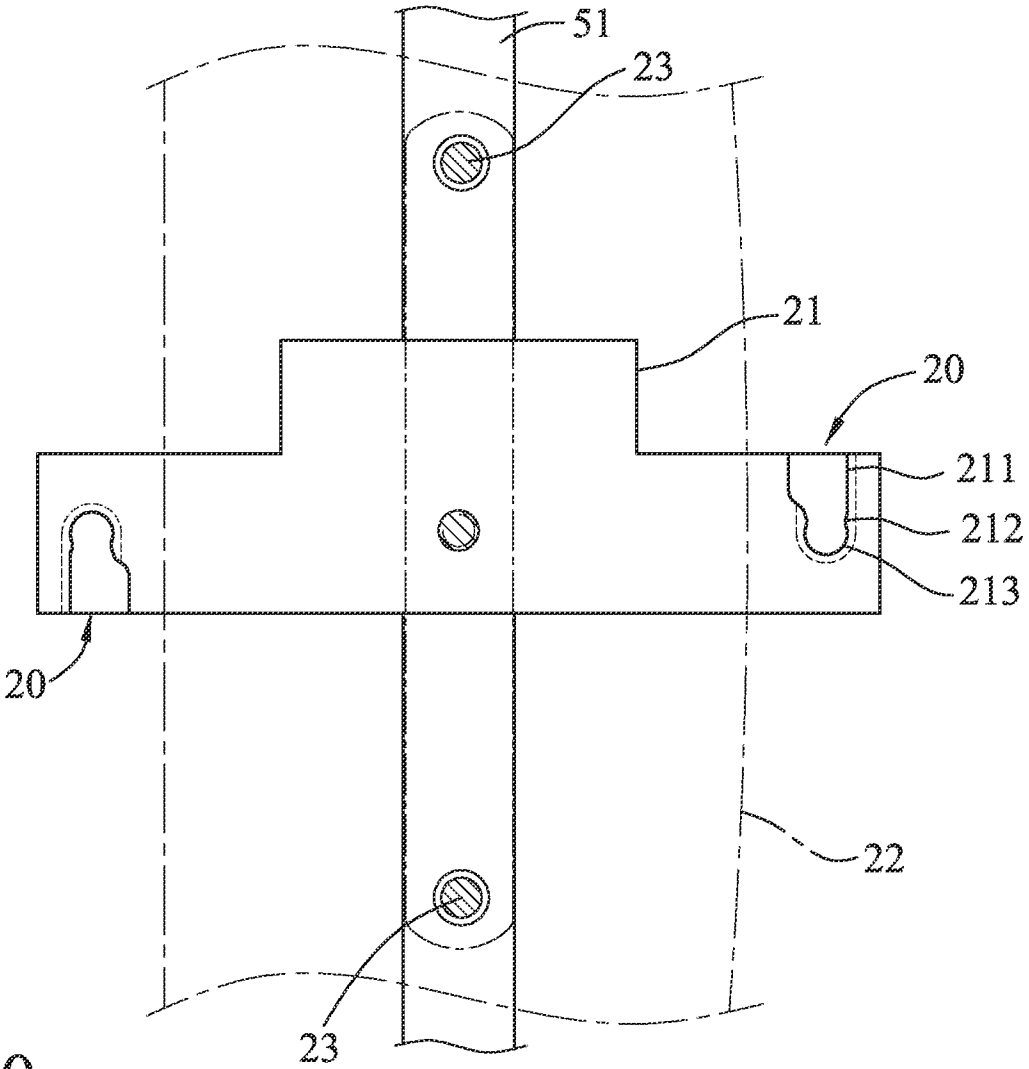
FIG. 10 is a view similar to FIG. 9, but illustrating the cushion pad rotated relative to the movable seat in a second state.

Referring to FIGS. 8 to 10, the cushion mechanism 2 is connected to the support unit 5, and includes a movable seat 21, a cushion pad 22, and two protrusions 23.

The movable seat 21 is sleeved on and slidable along the spine rod 51. In this embodiment, the movable seat 21 has a first end surface 214, a second end surface 215, a connecting surface 216, and two locking slots 20. The second end surface 215 is opposite to the first end surface 214. The connecting surface 216 interconnects the first end surface 214 and the second end surface 215. The locking slots 20 are respectively formed at an intersection of the first end surface 214 and the connecting surface 216 and an intersection of the second end surface 215 and the connecting surface 216. Each of the locking slots 20 has an entry portion 211, a limitation portion 213, and a press portion 212. The entry portion 211 extends from the respective one of the intersection of the first end surface 214 and the connecting surface 216 of the movable seat 21 and the intersection of the second end surface 215 and the connecting surface 216 of the movable seat 21. The limitation portion 213 is disposed away from the entry portion 211. The press portion 212 interconnects the entry portion 211 and the limitation portion 213, and that has a width smaller than those of the entry portion 211 and the limitation portion 213. In this embodiment, the movable seat 21 is sleeved fittingly on the spine rod 51.

The cushion pad 22 is connected to the movable seat 21 and is disposed between the movable seat 21 and the backrest cover 42 of the backrest unit 4. The cushion pad 22 abuts forwardly against the backrest cover 42 of the backrest unit 4 when the chair frame mechanism 1 is in the unfolded state.

The protrusions 23 are spaced apart from each other and are mounted to said cushion pad 22.

In this embodiment, the cushion pad 22 is rotatable relative to the movable seat 21 about an axis perpendicular to the spine rod 51 to convert between a first state and a second state. As shown in FIG. 9, in the first state of the cushion pad 22, the protrusions 23 engage respectively the locking slots 20, and the cushion pad 22 is disposed to be elongated horizontally. As shown in FIG. 10, in the second state of the cushion pad 22, the protrusions 23 are disengaged respectively from the locking slots 20, and the cushion pad 22 is disposed to be elongated vertically.

During conversion of the cushion pad 22 from the second state (see FIG. 10) to the first state (see FIG. 9), the cushion pad 22 is rotated relative to the movable seat 21 in a clockwise direction with reference to orientation of the Figures being described, and each of the protrusions 23 is moved sequentially past the entry portion 211 and the press portion 212 of the respective one of the locking slots 20, and into the limitation portion 213 of the respective one of the locking slots 20. In this embodiment, each of the protrusions 23 has a T-shaped cross section. When the cushion pad 22 is in the first state, the protrusions 23 are respectively fitted into and engaged with the limitation portions 213 of the locking slots 20.

Referring back to FIGS. 4 and 6, as the chair frame mechanism 1 is operated to the unfolded state, the seat cover 35 is unfolded by the seat rods 31, and the backrest cover 42 is unfolded by the backrest rods 41, so that the seat cover 35 and the backrest cover 42 cooperatively define a seating space 10. To meet a user's requirement, the movable seat 21 is moved by the user to slide upwardly and downwardly along the spine rod 51 so that the cushion pad 22 is adjusted to move into a required position relative to the user's lumbar or neck for increased comfort.

As shown in FIG. 7, when the backrest unit 4 is driven by the armrest unit 6 to be inclined by a great angle and backwardly relative to the seat unit 3, the cushion pad 22 together with the movable seat 21 is adjusted to move along the spine rod 51 in position corresponding to the user's neck. When the user lies in the foldable chair of the disclosure, the cushion pas 22 supports the user's neck to increase the comfort of the user.

Figure 11:
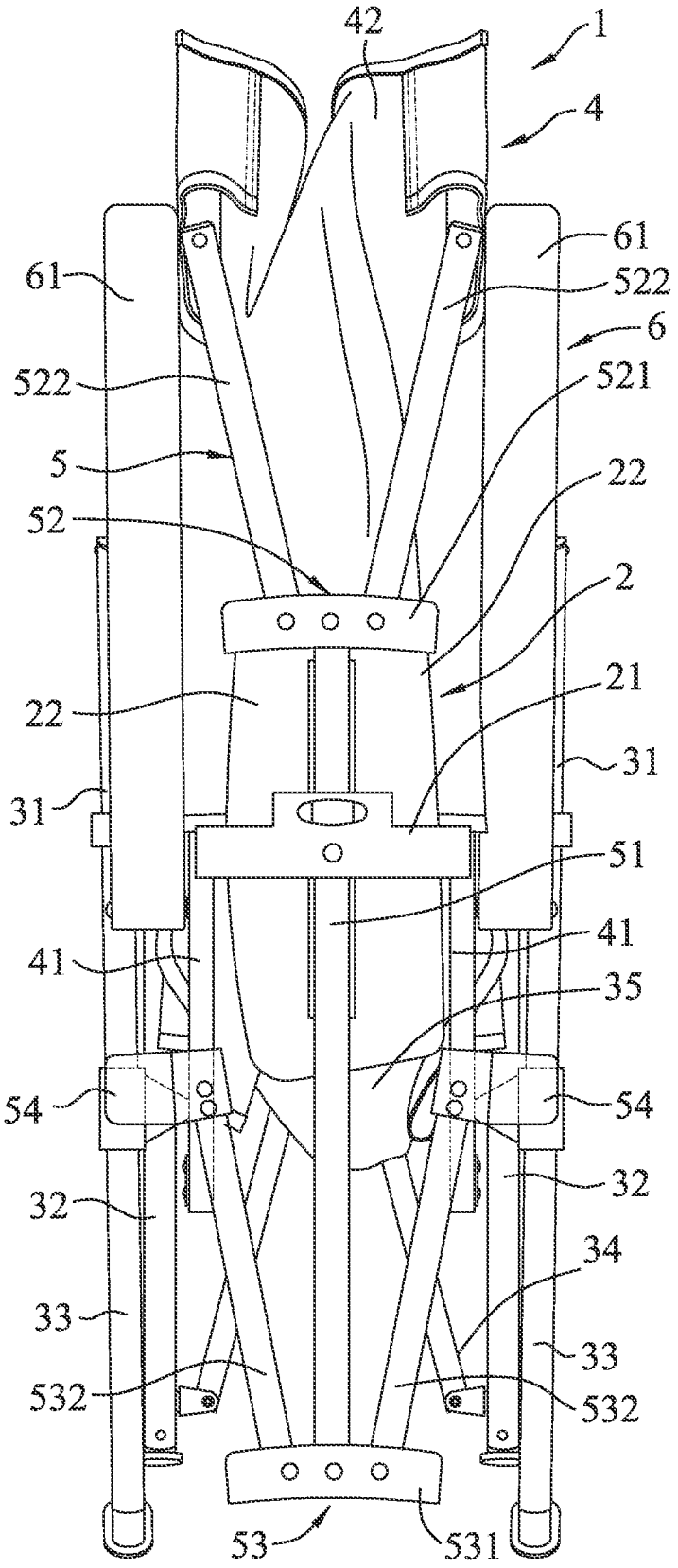
FIG. 11 is a rear view of the first embodiment, illustrating the foldable chair in a folded state.

Referring to FIG. 11 in combination with FIGS. 5 and 6, to operate the foldable chair from the unfolded state to the folded state, the first hinge seat 521 is pressed to move together with the spine rod 51 downwardly relative to the backrest unit 4 so that the first link rods 522 are pivotally rotated relative to the first hinge seat 521 so as to move toward each other above the spine rod 51, and so that the second link rods 532 are pivotally rotated relative to the second hinge seat 531 so as to move toward each other in position adjacent to the spine rod 51. The rod connectors 54 are driven by the second link rods 532 to be disengaged from the backrest rods 41, respectively. When the second link rods 532 are moved toward each other, the backrest rods 41 are driven to move toward each other in the left-right direction toward the spine rod 51 to fold the backrest cover 42, the seat rods 31 are moved toward to each other in the left-right direction to fold the seat cover 35, the front leg rods 32 are driven to move toward each other in the left-right direction, the rear leg rods 33 are driven to move toward each other in the left-right direction, the armrest bodies 61 are driven to move toward each other in the left-right direction, and the scissor link assembly 34 is folded. Subsequently, the armrest bodies 61 are lifted upwardly and respectively to move backward toward the backrest rods 41. By virtue of the respective positioning pin 36 extending in a slidable manner through the slide passage 602 of the respective engagement plate 62 between the respective front leg rod 32 and the respective rear leg rod 33, and by virtue of the positioning pins 36 respectively pivotally connecting the top ends of the front leg rods 32 and the rear leg rods 33, the backward movement of the armrest bodies 61 toward the backrest rods 41 drives the front leg rods 32, the rear leg rods 33, the folded seat cover 35, and the folded backrest cover 42 to move backward toward the backrest rods 41. As a result, the foldable chair of the disclosure is operated from the unfolded state to the folded state.

When the foldable chair is in the folded state, the movable seat 21 is rotated about the axis perpendicular to the spine rod 51 to the second state so that the cushion pad 22 is disposed to be elongated vertically to reduce a distance between the backrest rods 41, thereby further reducing size of the foldable chair in the folded state.

Figure 12:
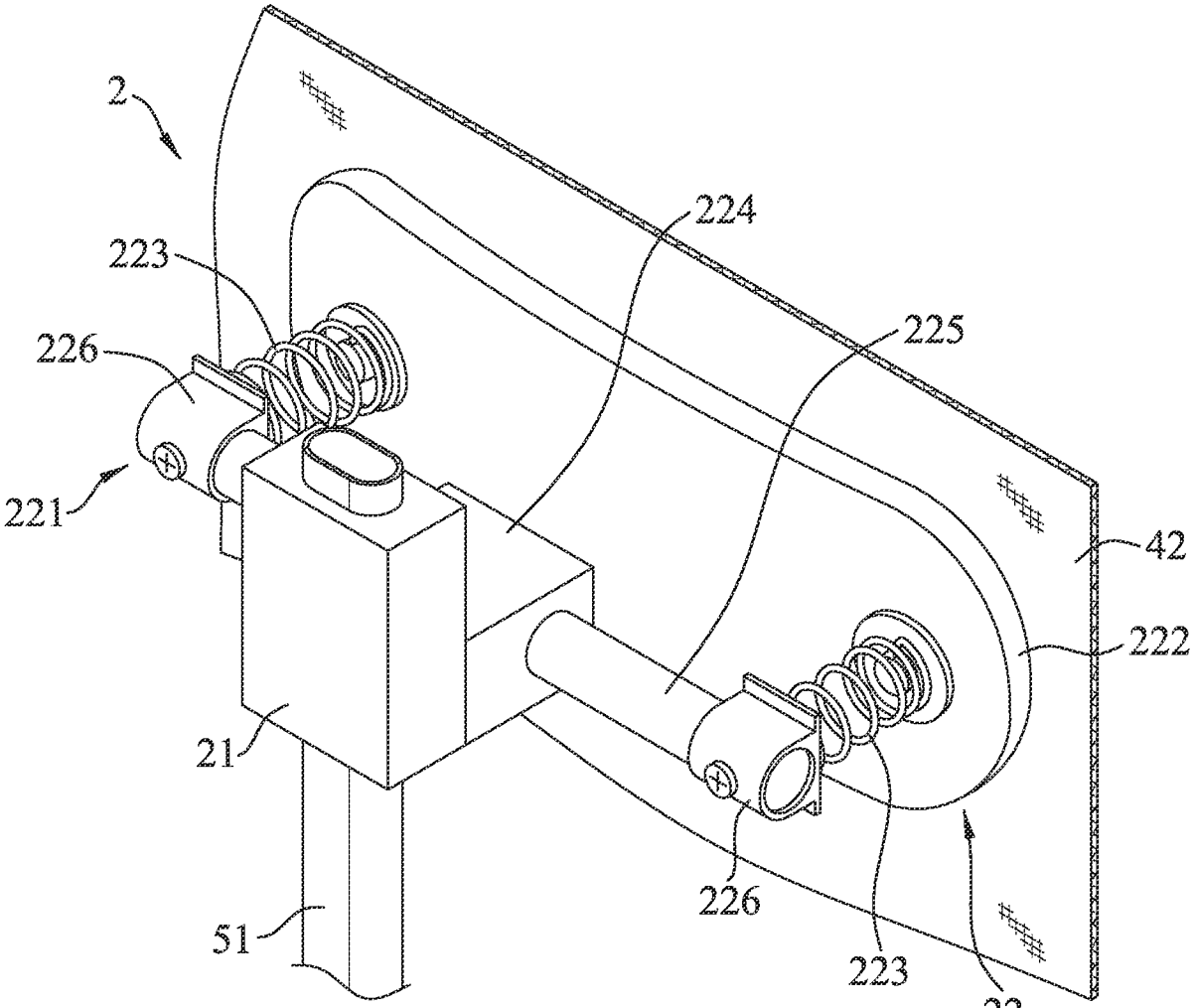
FIG. 12 is a fragmentary, partly sectional view illustrating a cushion mechanism of a foldable chair according to a second embodiment of the disclosure.

FIG. 12 illustrates a foldable chair according to a second embodiment of the disclosure, which has a structure generally similar to that of the first embodiment. However, the cushion mechanism 2 of the second embodiment is different in structural design from that of the first embodiment.

In the second embodiment, the cushion pad 22 of the cushion mechanism 2 has a connection member 221 and two resilient members 223. The connection member 221 is disposed rearwardly of the cushion body 222 in a spaced-apart manner, and is rotatably connected to the movable seat 21. The connection member 221 has a pivotal block 224, a rod body 225, and two sleeves 226. The pivotal block 224 is disposed rearwardly of the cushion body 222 and is rotatably connected to the movable seat 21. The pivotal block 224 is rotatable relative to the movable seat 21 about the axis perpendicular to the spine rod 51. The rod body 225 extends in the left-right direction through the pivotal block 224. The sleeves 226 are respectively sleeved on a left end and a right end of the rod body 225. The resilient members 223 are resiliently connected between the cushion body 222 and the connection member 221. In this embodiment, the resilient members 223 are respectively mounted to the sleeves 226.

When the foldable chair is unoccupied in the unfolded state, the cushion body 222 is resiliently urged by the resilient members 223 to move away from the connection member 221 and directly abut against the backrest cover 42 of the backrest unit 4. As the user sits in the foldable chair, the cushion pad 22 directly abuts against the user through the backrest cover 42, thereby producing a buffering effect and providing support to the user.

In other variants of the second embodiment, when the foldable chair is unoccupied in the unfolded state, the cushion body 222 is designed to be spaced apart from the backrest cover 42 while the cushion body 222 is resiliently urged by the resilient members 223 to move toward the backrest cover 42. As the user sits in the foldable chair, the backrest cover 42 is driven to move backward toward the cushion pad 22, and the cushion pad 22 may also produce a buffering effect and provide support to the user.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A foldable chair comprising:
- a chair frame mechanism operable between an unfolded state and a folded state, and including
- a seat unit,
- a backrest unit that extends upwardly from said seat unit, and
- a support unit that is mounted to said backrest unit, and that includes a spine rod disposed rearwardly of said backrest unit and being upwardly and downwardly movable for driving operation of said chair frame mechanism between the folded state and the unfolded state; and
- a cushion mechanism connected to said support unit, and including
  - a movable seat that is sleeved on and slidable along said spine rod, and
  - a cushion pad that is connected to said movable seat and that is disposed between said movable seat and said backrest unit;
  - wherein said cushion pad is rotatable relative to said movable seat about an axis perpendicular to said spine rod.

2. The foldable chair as claimed in claim 1, wherein said cushion pad abuts forwardly against said backrest unit when said chair frame mechanism is in the unfolded state.

3. The foldable chair as claimed in claim 1, wherein:
- said movable seat has a first end surface, a second end surface that is opposite to said first end surface, a connecting surface that interconnects said first end surface and said second end surface, and two locking slots that are respectively formed at an intersection of said first end surface and said connecting surface and an intersection of said second end surface and said connecting surface;
- said cushion mechanism further includes two protrusions that are mounted to said cushion pad; and
- said cushion pad is rotatable relative to said movable seat about the axis perpendicular to said spine rod to convert between a first state, in which said protrusions engage respectively said locking slots, and a second state, in which said protrusions are disengaged respectively from said locking slots.

4. The foldable chair as claimed in claim 3, wherein said cushion pad is rotatable relative to said movable seat about the axis perpendicular to said spine rod to convert between a first state, in which said protrusions engage respectively said locking slots and in which said cushion pad is disposed to be elongated horizontally, and a second state, in which said protrusions are disengaged respectively from said locking slots and in which said cushion pad is disposed to be elongated vertically.

5. The foldable chair as claimed in claim 3, wherein:
- each of said locking slots has
  - an entry portion that extends from the respective one of said intersection of said first end surface and said connecting surface of said movable seat and said intersection of said second end surface and said connecting surface of said movable seat,
  - a limitation portion that is disposed away from said entry portion, and
    - a press portion that interconnects said entry portion and said limitation portion, and that has a width smaller than those of said entry portion and said limitation portion; and
- during conversion of said cushion pad from the second state to the first state, each of said protrusions is moved sequentially past said entry portion and said press portion of the respective one of said locking slots, and into said limitation portion of the respective one of said locking slots.

6. The foldable chair as claimed in claim 1, wherein said cushion pad has:
- a cushion body that is disposed rearwardly of said backrest unit;

a connection member that is disposed rearwardly of said cushion body in a spaced-apart manner and that is rotatably connected to said movable seat; and two resilient members that are resiliently connected between said cushion body and said connection member.

7. The foldable chair as claimed in claim 6, wherein said cushion body is resiliently urged by said resilient members toward said backrest unit.

8. The foldable chair as claimed in claim 1, wherein said movable seat is sleeved fittingly on said spine rod.

* * * * *